US010743646B2

(12) United States Patent
Jimenez et al.

(10) Patent No.: US 10,743,646 B2
(45) **Date of Patent: *Aug. 18, 2020**

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Robert Moskovich, East Brunswick, NJ (US); Andreas Wechsler, Zell am See (AT); Joachim Storz, Zell am See (AT)

(73) Assignee: Colgate-Palmolive Company, New York, NY (US)

( * ) Notice: Subject to any disclaimer, the term of this patent is extended or adjusted under 35 U.S.C. 154(b) by 181 days.

This patent is subject to a terminal disclaimer.

(21) Appl. No.: 15/539,369

(22) PCT Filed: Dec. 23, 2014

(86) PCT No.: PCT/US2014/072048
§ 371 (c)(1),
(2) Date: Jun. 23, 2017

(87) PCT Pub. No.: WO2016/105359
PCT Pub. Date: Jun. 30, 2016

(65) Prior Publication Data

US 2017/0367469 A1 Dec. 28, 2017

(51) Int. Cl.
*A46B 9/04* (2006.01)
*A46B 9/00* (2006.01)
(Continued)

(52) U.S. Cl.
CPC ..... *A46B 9/04* (2013.01); *A46B 9/005* (2013.01); *A46B 9/025* (2013.01); *A46B 9/028* (2013.01);
(Continued)

(58) Field of Classification Search
CPC ..... A61C 17/222; A46B 9/04; A46B 9/08
See application file for complete search history.

(56) References Cited

U.S. PATENT DOCUMENTS 758,764 A 5/1904 MacLeod
846,900 A 3/1907 Bloom
(Continued)

FOREIGN PATENT DOCUMENTS

AR 71556 10/2003
AR 80042 11/2009
(Continued)

OTHER PUBLICATIONS

International Search Report and the Written Opinion issued in International Application PCT/US2010/046806 dated Mar. 16, 2011.
(Continued)

*Primary Examiner* — Brian D Keller

(57) ABSTRACT

An oral care implement that includes a head having tooth cleaning elements including at least one conical tuft of bristles. The conical tuft of bristles defines a cavity that has a transverse cross-sectional area that increases with distance from the head. The tooth cleaning elements may also include one or more arcuate cleaning elements that at least partially surround the conical tuft. The tooth cleaning elements may also include multi-height bristle tufts along lateral sides of the head. Furthermore, the head may have two conical tufts such that one of the conical tufts is oriented at a smaller acute angle relative to the head than the other conical tuft and/or one of the conical tufts is taller than the other conical tuft.

15 Claims, 7 Drawing Sheets

(51) Int. Cl.
*A46B 9/06* (2006.01)
*A46B 9/02* (2006.01)

(52) U.S. Cl.
CPC ..... *A46B 9/06* (2013.01); *A46B 2200/1066* (2013.01)

(56) References Cited

U.S. PATENT DOCUMENTS 1,125,532 A 1/1915 Himmel
1,901,230 A 3/1933 Palmer
1,924,152 A 8/1933 Coney et al.
1,935,099 A * 11/1933 O'donnell ..... A46B 3/00 15/188
2,161,349 A 6/1939 Hadden
2,186,005 A 1/1940 Casto
2,305,461 A 12/1942 Spyra
3,792,504 A 2/1974 Smith
D273,635 S 5/1984 Stocchi
4,517,701 A 5/1985 Stanford, Jr.
4,958,402 A 9/1990 Weihrauch
5,144,712 A 9/1992 Hansel et al.
5,339,482 A 8/1994 Desimone et al.
5,392,483 A 2/1995 Heinzelman et al.
5,584,690 A 12/1996 Maassarani
5,604,951 A 2/1997 Shipp
5,628,082 A 5/1997 Moskovich
5,651,158 A 7/1997 Halm
D390,706 S 2/1998 Hohlbein et al.
5,735,012 A 4/1998 Heinzelman et al.
5,746,532 A 5/1998 Megill et al.
5,758,383 A 6/1998 Hohlbein
5,781,958 A 7/1998 Meessmann et al.
5,799,353 A 9/1998 Yamamoto et al.
5,802,656 A 9/1998 Dawson et al.
5,839,149 A 11/1998 Scheier et al.
D404,205 S 1/1999 Hohlbein
D404,206 S 1/1999 Hohlbein
5,862,559 A 1/1999 Hunter
5,863,102 A 1/1999 Waguespack et al.
5,908,038 A 6/1999 Bennett
5,915,868 A 6/1999 Frazell
5,930,860 A 8/1999 Shipp
5,946,758 A 9/1999 Hohlbein et al.
5,967,152 A 10/1999 Rimkus
5,970,564 A 10/1999 Inns et al.
5,984,935 A 11/1999 Budei et al.
5,991,958 A 11/1999 Hohlbein
6,015,293 A 1/2000 Rimkus
6,032,313 A 3/2000 Tsang
6,041,468 A 3/2000 Chen et al.
6,073,299 A 6/2000 Hohlbein
6,088,870 A 7/2000 Hohlbein
D429,887 S 8/2000 Hohlbein et al.
6,099,780 A 8/2000 Gellert
6,131,228 A 10/2000 Chen et al.
6,178,583 B1 1/2001 Volpenhein
6,202,241 B1 * 3/2001 Hassell ..... A46B 9/045 15/167.1
6,234,798 B1 5/2001 Salazar et al.
6,276,021 B1 8/2001 Hohlbein
6,292,973 B1 9/2001 Moskovich et al.
D450,457 S 11/2001 Hohlbein
D450,929 S 11/2001 Angelini et al.
6,314,606 B1 11/2001 Hohlbein
D451,286 S 12/2001 Hohlbein
D456,138 S 4/2002 Hohlbein
D456,139 S 4/2002 Hohlbein
6,370,726 B1 4/2002 Kini et al.
D457,323 S 5/2002 Hohlbein
6,397,425 B1 6/2002 Szczech et al.
6,408,476 B1 6/2002 Cann
6,421,867 B1 7/2002 Weihrauch
D461,313 S 8/2002 Hohlbein
6,442,786 B2 9/2002 Halm
6,442,787 B2 9/2002 Hohlbein
D464,133 S 10/2002 Barnett et al.
6,463,618 B1 10/2002 Zimmer
D474,608 S 5/2003 Hohlbein
6,564,416 B1 5/2003 Claire et al.
6,596,213 B2 6/2003 Swenson
6,595,087 B2 7/2003 Whalen et al.
6,599,048 B2 7/2003 Kuo
6,601,272 B2 8/2003 Stvartak et al.
6,658,688 B2 12/2003 Gavney, Jr.
D486,649 S 2/2004 Sprosta et al.
6,687,940 B1 2/2004 Gross et al.
6,749,788 B1 6/2004 Holden et al.
6,766,549 B2 7/2004 Klupt
6,792,642 B2 9/2004 Wagstaff
6,820,299 B2 11/2004 Gavney, Jr.
6,820,300 B2 11/2004 Gavney, Jr.
6,859,969 B2 3/2005 Gavney, Jr. et al.
D503,538 S 4/2005 Desalvo
6,886,207 B1 5/2005 Solanki
6,889,405 B2 5/2005 Ritrovato et al.
6,919,038 B2 7/2005 Meyer et al.
6,957,469 B2 10/2005 Davies
D511,249 S 11/2005 Hohlbein
6,972,106 B2 12/2005 Huber et al.
D513,882 S 1/2006 Hohlbein et al.
6,983,507 B2 1/2006 McDougall
D514,320 S 2/2006 Hohlbein
D514,812 S 2/2006 Hohlbein et al.
6,996,870 B2 2/2006 Hohlbein
D516,819 S 3/2006 Hohlbein
D517,812 S 3/2006 Hohlbein et al.
D517,813 S 3/2006 Hohlbein et al.
7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 8/2006 Hohlbein
D527,528 S 9/2006 Hohlbein
D528,803 S 9/2006 Hohlbein
D532,202 S 11/2006 Hohlbein
D532,607 S 11/2006 Hohlbein
7,143,462 B2 12/2006 Hohlbein
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 1/2009 Hohlbein et al.
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.
7,721,376 B2 5/2010 Hohlbein et al.
7,722,274 B2 5/2010 Hohlbein et al.
7,735,174 B2 6/2010 Hohlbein et al.
D623,415 S 9/2010 Geiberger

(56) References Cited

U.S. PATENT DOCUMENTS

| | | | | |
|---|---|---|---|---|
| 7,788,756 | B2 | 9/2010 | Kraemer | |
| 7,845,042 | B2 | 12/2010 | Moskovich et al. | |
| 7,854,036 | B2 | 12/2010 | Georgi | |
| 7,937,794 | B2 | 5/2011 | Huber et al. | |
| 7,954,191 | B2 | 6/2011 | Hohlbein | |
| 7,958,589 | B2 | 6/2011 | Braun et al. | |
| 7,975,343 | B2 | 7/2011 | Hohlbein et al. | |
| 7,975,346 | B2 | 7/2011 | Moskovch et al. | |
| 7,979,947 | B2 | 7/2011 | Storkel et al. | |
| 8,032,991 | B2 | 10/2011 | Lawless | |
| 8,042,217 | B2 | 10/2011 | Sorrentino | |
| 8,046,864 | B2 | 11/2011 | Baertschi et al. | |
| 8,060,972 | B2 | 11/2011 | Geiberger et al. | |
| 8,083,980 | B2 | 12/2011 | Huber et al. | |
| 8,239,996 | B2 | 8/2012 | Garber et al. | |
| 8,307,488 | B2 | 11/2012 | Pfenniger et al. | |
| 8,327,492 | B2 | 12/2012 | Cann | |
| 8,332,982 | B2 | 12/2012 | Braun et al. | |
| 8,332,985 | B2 | 12/2012 | Solanki | |
| 8,382,208 | B2 | 2/2013 | Baertschi et al. | |
| 8,448,284 | B2 | 5/2013 | Gross et al. | |
| 8,448,287 | B2 | 5/2013 | Ponzini et al. | |
| 8,458,846 | B2 | 6/2013 | Schamberg et al. | |
| 8,484,789 | B2 | 7/2013 | Claire-Zimmet et al. | |
| 8,500,766 | B2 | 8/2013 | Jimenez et al. | |
| 8,528,148 | B2 | 9/2013 | Brown, Jr. et al. | |
| 8,595,886 | B2 | 12/2013 | Edelstein et al. | |
| 8,601,635 | B2 | 12/2013 | Goldman et al. | |
| 8,608,251 | B2 | 12/2013 | Nirwing et al. | |
| 8,621,698 | B2 | 1/2014 | Chenvainu et al. | |
| 8,631,534 | B2 | 1/2014 | Blanchard et al. | |
| 8,732,890 | B2 | 5/2014 | Mohr et al. | |
| 8,739,351 | B2 | 6/2014 | Kling et al. | |
| 8,776,302 | B2 | 7/2014 | Baertschi et al. | |
| 8,813,292 | B2 | 8/2014 | Driesen et al. | |
| 2002/0017003 | A1 | 2/2002 | Kramer et al. | |
| 2002/0138928 | A1 | 10/2002 | Calabrese | |
| 2003/0163881 | A1 | 9/2003 | Driesen et al. | |
| 2003/0178745 | A1 | 9/2003 | Scarabelli et al. | |
| 2003/0178885 | A1 | 9/2003 | Weihrauch | |
| 2004/0025275 | A1 | 2/2004 | Moskovich et al. | |
| 2004/0107521 | A1 | 6/2004 | Chan et al. | |
| 2004/0134007 | A1 | 7/2004 | Davies | |
| 2005/0166343 | A1* | 8/2005 | Gavney, Jr. ..... | A46B 15/0002 15/110 |
| 2005/0210612 | A1* | 9/2005 | Hohlbein ..... | A46B 9/04 15/110 |
| 2006/0048314 | A1 | 3/2006 | Kressner | |
| 2006/0048323 | A1 | 3/2006 | Rueb | |
| 2006/0064827 | A1 | 3/2006 | Chan | |
| 2006/0123574 | A1 | 6/2006 | Storkel et al. | |
| 2006/0200925 | A1* | 9/2006 | Moskovich ..... | A46B 5/0029 15/167.1 |
| 2006/0236477 | A1 | 10/2006 | Gavney, Jr. | |
| 2006/0236478 | A1 | 10/2006 | Hohlbein et al. | |
| 2006/0248667 | A1 | 11/2006 | Kraemer | |
| 2007/0151058 | A1 | 7/2007 | Kraemer et al. | |
| 2007/0169295 | A1 | 7/2007 | Winter et al. | |
| 2007/0265555 | A1 | 11/2007 | Deng | |
| 2007/0283517 | A1 | 12/2007 | Blanchard et al. | |
| 2009/0007357 | A1 | 1/2009 | Meadows et al. | |
| 2009/0038097 | A1 | 2/2009 | Geiberger | |
| 2009/0158543 | A1 | 6/2009 | Lee | |
| 2009/0255077 | A1 | 10/2009 | Mori et al. | |
| 2010/0043162 | A1 | 2/2010 | Kling et al. | |
| 2010/0058550 | A1 | 3/2010 | Ballmaier et al. | |
| 2010/0088836 | A1 | 4/2010 | Kirchhofer et al. | |
| 2010/0101037 | A1 | 4/2010 | Hilfiker et al. | |
| 2010/0115724 | A1 | 5/2010 | Huang | |
| 2010/0180392 | A1 | 7/2010 | Binet et al. | |
| 2010/0223746 | A1 | 9/2010 | Mueller | |
| 2010/0263149 | A1 | 10/2010 | Ballmaier et al. | |
| 2010/0306941 | A1 | 12/2010 | Erskine-Smith et al. | |
| 2011/0030160 | A1 | 2/2011 | Knutzen et al. | |
| 2011/0047736 | A1* | 3/2011 | Jimenez ..... | A46B 9/04 15/167.2 |
| 2011/0138560 | A1 | 6/2011 | Vitt et al. | |
| 2011/0219558 | A1 | 9/2011 | Vitt et al. | |
| 2011/0109149 | A1 | 12/2011 | Loetscher et al. | |
| 2012/0034576 | A1 | 2/2012 | Mostafa | |
| 2012/0192369 | A1 | 8/2012 | Mohr et al. | |
| 2012/0266400 | A1* | 10/2012 | Jimenez ..... | A46B 9/04 15/105 |
| 2013/0007968 | A1 | 1/2013 | Driesen et al. | |
| 2013/0036566 | A1 | 2/2013 | Schlatter | |
| 2013/0139338 | A1 | 6/2013 | Hess et al. | |
| 2013/0269128 | A1 | 10/2013 | Jimenez | |
| 2013/0291320 | A1 | 11/2013 | Kirchhofer et al. | |
| 2013/0333126 | A1 | 12/2013 | Miller | |
| 2014/0047656 | A1 | 2/2014 | Newman et al. | |
| 2014/0158152 | A1 | 6/2014 | Kirchhofer et al. | |
| 2014/0173838 | A1 | 6/2014 | Dickie et al. | |
| 2014/0173853 | A1 | 6/2014 | Kirchhofer et al. | |
| 2014/0298605 | A1 | 10/2014 | Ivory | |
| 2014/0310901 | A1 | 10/2014 | Geiberger et al. | |
| 2015/0327666 | A1 | 11/2015 | Hohlbein | |

FOREIGN PATENT DOCUMENTS

| | | | |
|---|---|---|---|
| BR | 7900283 | | 8/2000 |
| BR | DI 6601454-9 | | 4/2006 |
| BR | DI 6702593 | | 8/2007 |
| BR | DI 6805210-3 | | 11/2008 |
| BR | DI 6902120-1 | | 5/2009 |
| BR | DI 6903329-3 | | 8/2009 |
| BR | DI 6903330-7 | | 8/2009 |
| BR | DI 6904386 | | 11/2009 |
| BR | DI 7102178-7 | | 4/2011 |
| BR | 30 2013 000448-1 | | 2/2013 |
| BR | DI 6401609-9 | | 5/2014 |
| CH | 215110 | | 6/1941 |
| CN | 3372860D | | 6/2004 |
| CN | 3372861D | | 6/2004 |
| CN | 2732059 | | 10/2005 |
| CN | 300704339 | | 10/2007 |
| CN | 201294969 | | 8/2009 |
| CN | 201518876 | | 7/2010 |
| CN | 201518877 | | 7/2010 |
| CN | 201518880 | | 7/2010 |
| CN | 201528796 | | 7/2010 |
| CN | 201541995 | | 8/2010 |
| CN | 201541996 | | 8/2010 |
| CN | 201541997 | | 8/2010 |
| CN | 201550827 | | 8/2010 |
| CN | 301406316 | S | 12/2010 |
| CN | 301421505 | S | 12/2010 |
| CN | 201814085 | | 5/2011 |
| CN | 201986933 | | 9/2011 |
| CN | 301763519 | | 12/2011 |
| CN | 30198826 | | 5/2012 |
| CN | 302058056 | | 9/2012 |
| CN | 302225957 | S | 12/2012 |
| CN | 302328863 | S | 2/2013 |
| CN | 202800555 | | 3/2013 |
| CN | 103005839 | | 4/2013 |
| CN | 203194906 | | 9/2013 |
| CN | 203220069 | | 10/2013 |
| CN | 203220073 | | 10/2013 |
| CN | 203252150 | | 10/2013 |
| CN | 302956580 | S | 10/2014 |
| DE | 19858102 | | 6/2000 |
| DE | 202005009026 | | 10/2005 |
| DE | 102006016939 | | 5/2007 |
| DE | 102006005616 | | 8/2007 |
| DE | 102006024874 | | 11/2007 |
| DE | 202008016004 | | 2/2009 |
| DE | 102014002960 | | 9/2014 |
| EM | 000366984-0001 | | 7/2005 |
| EM | 000638028-0002 | | 12/2006 |
| EM | 001975079-0005 | | 1/2012 |
| EM | 002163675-0002 | | 1/2013 |
| EM | 002163675-0003 | | 1/2013 |
| EM | 002212522-0004 | | 4/2013 |

(56) References Cited

FOREIGN PATENT DOCUMENTS

| | | |
|---|---|---|
| EM | 002212522-0012 | 4/2013 |
| EM | 002424069-0001 | 3/2014 |
| EP | 0716821 | 6/1996 |
| EP | 0769920 | 9/2003 |
| EP | 2810581 | 12/2014 |
| ES | 1063617 | 11/2006 |
| IT | 2010PDO000035-0019 | 10/2010 |
| JP | H08164025 | 6/1996 |
| JP | 10042957 | 8/1996 |
| JP | D1314270 | 10/2007 |
| KR | 20040032038 | 4/2004 |
| KR | 838174 | 6/2007 |
| KR | 20-2012-0005449 | 7/2012 |
| MX | 32553 | 11/2009 |
| MX | 36113 | 4/2011 |
| MX | 36650 | 4/2011 |
| RU | 55985 | 1/2005 |
| RU | 79787 | 10/2011 |
| RU | 80086 | 11/2011 |
| RU | 81915 | 6/2012 |
| WO | WO1995/06420 | 3/1995 |
| WO | WO1995/10959 | 4/1995 |
| WO | WO1999/023910 | 5/1999 |
| WO | WO1999/55514 | 11/1999 |
| WO | WO1999/65358 | 12/1999 |
| WO | WO2000/49911 | 8/2000 |
| WO | WO2001/17392 | 3/2001 |
| WO | WO2001/29128 | 4/2001 |
| WO | WO2001/45573 | 6/2001 |
| WO | WO2001/182741 | 11/2001 |
| WO | WO2004/043669 | 5/2004 |
| WO | WO2005/122827 | 12/2005 |
| WO | WO2008/017996 | 2/2008 |
| WO | WO2011/070549 | 6/2011 |
| WO | WO2012/017923 | 2/2012 |
| WO | WO2012/115035 | 8/2012 |
| WO | WO2012/176741 | 12/2012 |
| WO | WO2013/031685 | 3/2013 |

OTHER PUBLICATIONS

International Search Report and the Written Opinion issued in International Application PCT/US2012/070760 dated Oct. 14, 2013.
International Search Report and the Written Opinion issued in International Application PCT/US2014/072048 dated Nov. 20, 2015.

* cited by examiner

ORAL CARE IMPLEMENT

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing. Therefore, a need exists for an oral care implement having an improved arrangement of bristles.

BRIEF SUMMARY

The present invention is directed to an oral care implement that includes a handle and a head with a front surface. A plurality of tooth cleaning elements extend from the front surface. The plurality of tooth cleaning elements include one or more conical tufts that are formed by a continuous wall of bristles. The conical tufts have an inner surface that defines a cavity. The cavity has a transverse cross-sectional area that increases with distance from the front surface of the head. The tooth cleaning elements may also include one or more arcuate cleaning elements that surround the conical tufts. The tooth cleaning elements may also include multi-height bristle tufts that include smaller and taller bristles positioned within a single tuft hole.

In one aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head, the conical tuft terminating in an annular top surface, the annular top surface being a first height from the front surface of the head; the plurality of tooth cleaning elements comprising an arcuate cleaning element at least partially surrounding the conical tuft, the arcuate cleaning element having a top surface having a high point being a second height from the front surface of the head and a first low point being a third height from the front surface of the head; and wherein the first height is greater than the third height and less than the second height.

In another aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head; the plurality of tooth cleaning elements comprising an arcuate cleaning element at least partially surrounding the conical tuft; and wherein the arcuate cleaning element is either a distal-most tooth cleaning element on the head or a proximal-most tooth cleaning element on the head.

In yet another aspect, the invention can be an oral care implement comprising: a handle; a head coupled to the handle, the head comprising a front surface and a longitudinal axis extending from a proximal end of the head to a distal end of the head; a plurality of tooth cleaning elements extending from the front surface of the head; the plurality of tooth cleaning elements comprising a first conical tuft comprising a first bristle wall having an inner surface defining a first cavity along a first cavity axis, the first cavity having a first transverse cross-sectional area that increases with distance from the front surface of the head, the first bristle wall having an outer surface that forms a first acute angle with the front surface; the plurality of tooth cleaning elements comprising a second conical tuft comprising a second bristle wall having an inner surface defining a second cavity along a second cavity axis, the second cavity having a second transverse cross-sectional area that increases with distance from the front surface of the head, the second bristle wall having an outer surface that forms a second acute angle with the front surface; and wherein the first and second acute angles are different from one another.

In still another embodiment, the invention can be an oral care implement comprising: a handle; a head coupled to the handle, the head comprising a front surface; a plurality of tooth cleaning elements extending from the front surface of the head; the plurality of tooth cleaning elements comprising a multi-height bristle tuft extending from a single tuft hole along a tuft axis, the multi-height bristle tuft comprising a first bristle tuft section formed by taller bristles and a second bristle tuft section formed by shorter bristles, the second bristle tuft section having a U-shaped transverse cross-section that partially surrounds a transverse cross-section of the first bristle tuft section, and the first bristle tuft section axially protrudes from an upper surface of the second bristle tuft section.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
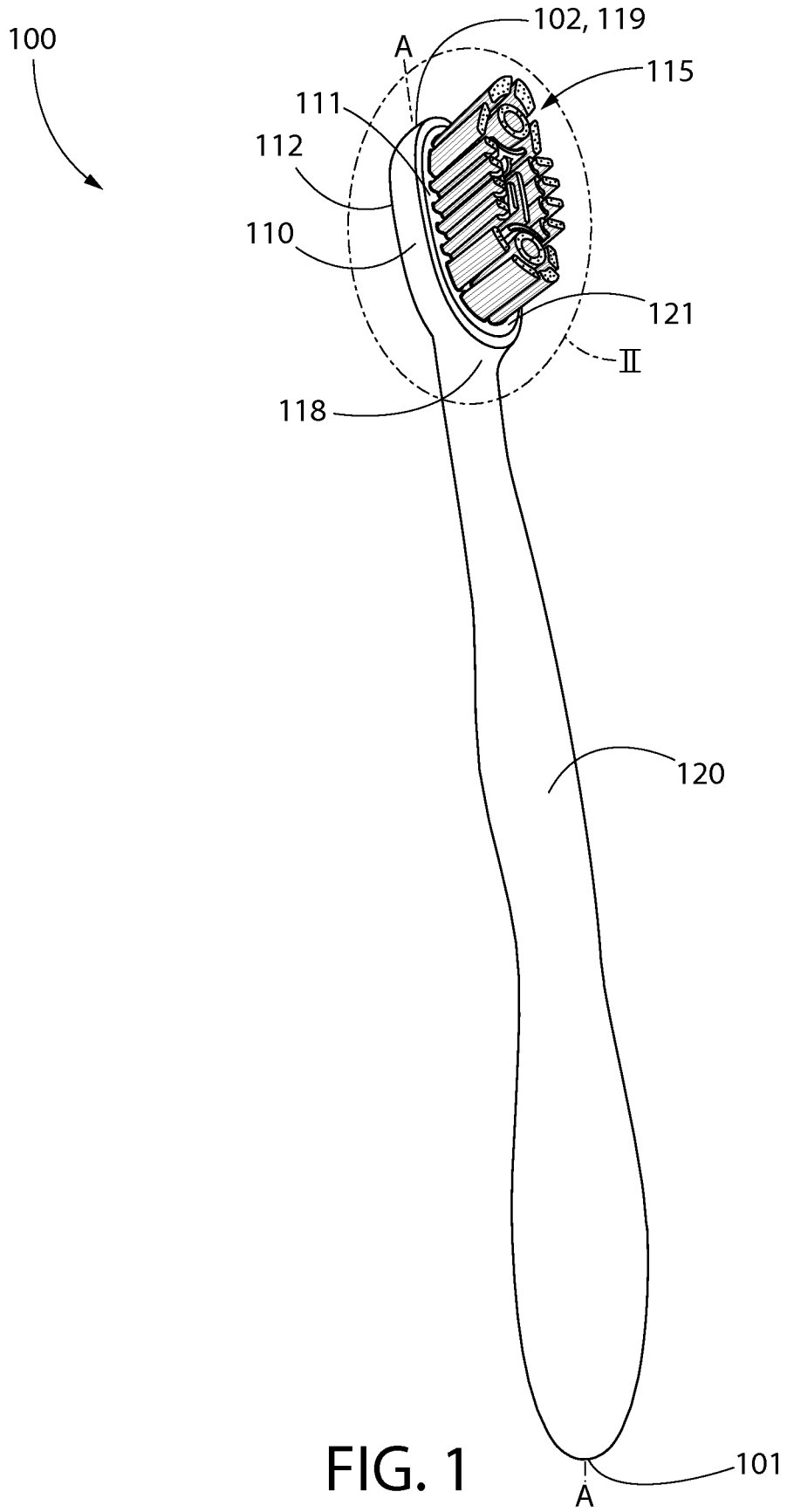
FIG. 1 is a front perspective view of an oral care implement in accordance with one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
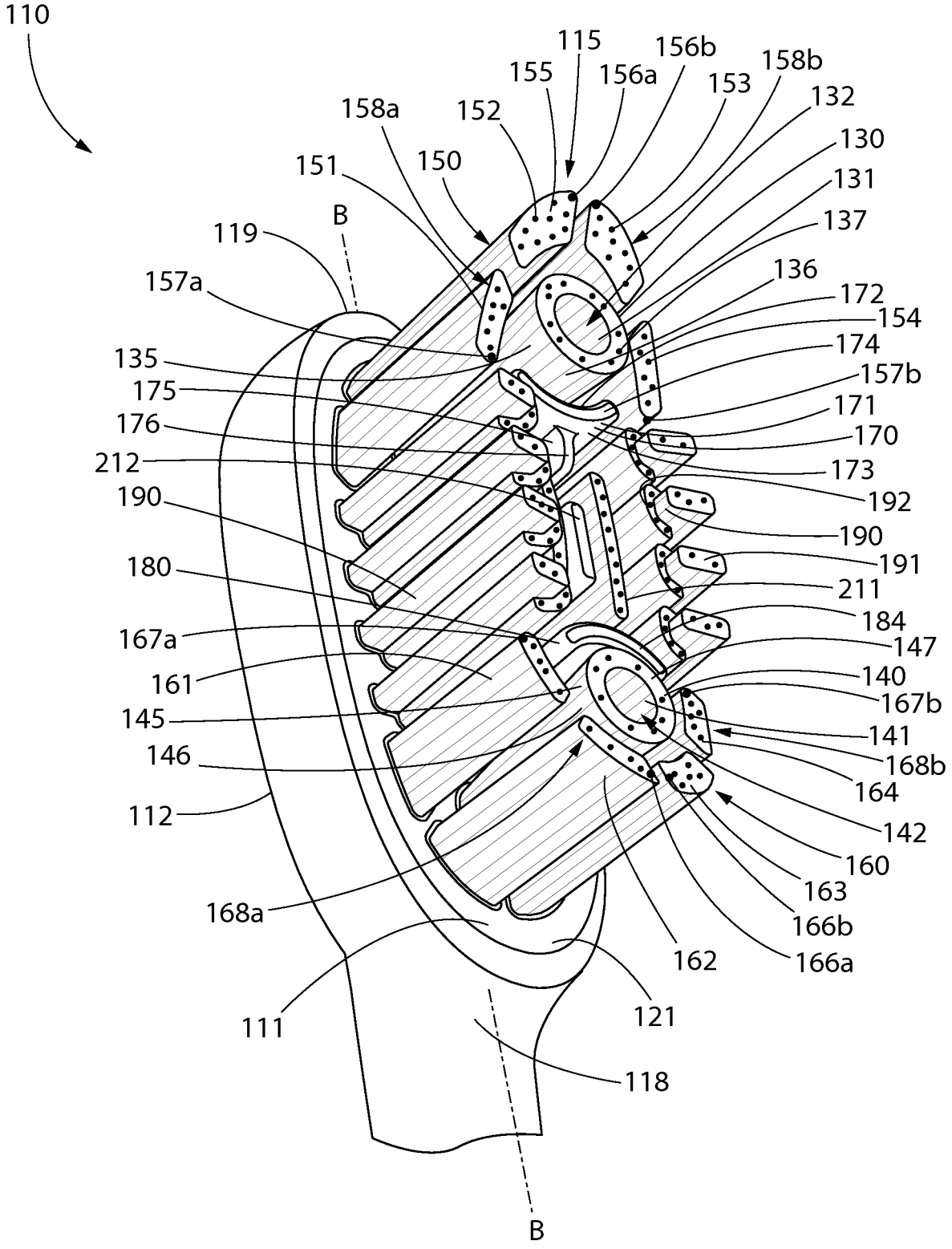
FIG. 2 is a close-up view of a head of the oral care implement of FIG. 1 as indicated by area II of FIG. 1.
Figure 3:
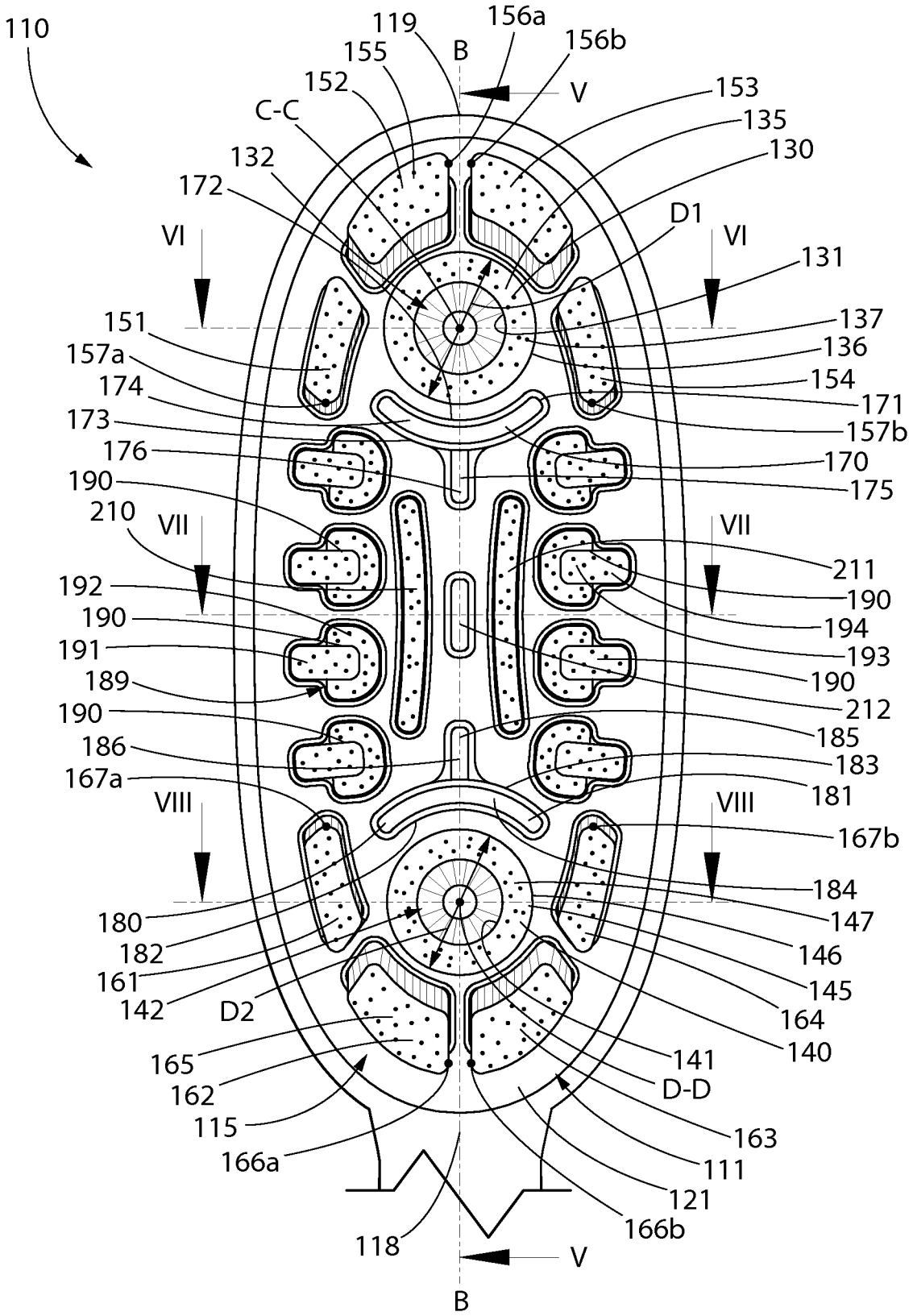
FIG. 3 is a front view of the head of the oral care implement of FIG. 2.

Referring first to FIGS. 1-3 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 extends from a proximal end 101 to a distal end 102 along a longitudinal axis A-A. The oral care implement 100 generally comprises a head 110 and a handle 120. The head 110 extends from a proximal end 118 to a distal end 119 along a longitudinal axis B-B that is coextensive with the longitudinal axis A-A of the oral care implement 100. Furthermore, in the exemplified embodiment the distal end 102 of the oral care implement 100 is the same as the distal end 119 of the head 110.

The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The details of certain ones of the plurality of tooth cleaning elements 115 will be discussed below, including specific details with regard to structure, pattern, orientation, and material of such tooth cleaning elements 115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring now to FIGS. 1-8 concurrently, one manner in which the tooth cleaning elements 115 are secured to the head 110 will be described. Specifically, in the exemplified embodiment the tooth cleaning elements 115 are formed as a cleaning element assembly on a head plate 121 such that one or more of the tooth cleaning elements 115 are mounted onto the head plate 121 and then the head plate 121 is coupled to the head 110. In such an embodiment, the head plate 121 is a separate and distinct component from the head 110 of the oral care implement 100. However, the head plate 121 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 121 and the head 110 are separately formed components that are secured together during manufacture of the oral care implement 100.

In certain embodiments, the head plate 121 may comprise a plurality of holes 122 formed therethrough, and the tooth cleaning elements 115 may be mounted to the head plate 121 within the holes 122. This type of technique for mounting the tooth cleaning elements 115 to the head 110 via the head plate 121 is generally known as anchor free tufting (AFT). Specifically, in AFT a plate or membrane (i.e., the head plate 121) is created separately from the head 110. The tooth cleaning elements 115 (such as bristles, elastomeric elements, and combinations thereof) are positioned into the head plate 121 so as to extend through the holes 122 of the head plate 121. The free ends of the tooth cleaning elements 115 on one side of the head plate 121 perform the cleaning function. The ends of the tooth cleaning elements 115 on the other side of the head plate 121 are melted together by heat to be anchored in place. As the tooth cleaning elements 105 are melted together, a melt matte 106 is formed. After the tooth cleaning elements 115 are secured to the head plate 121, the head plate 121 is secured to the head 110 such as by ultrasonic welding. When the head plate 121 is coupled to the head 110, the melt matte 106 is located between a lower surface 123 of the head plate 121 and a floor 107 of a basin 108 of the head 110 in which the head plate 121 is disposed. The melt matte 106, which is coupled directly to and in fact forms a part of the tooth cleaning elements 115, prevents the tooth cleaning elements 115 from being pulled through the holes 122 in the head plate 121 to ensure that the tooth cleaning elements 105 remain attached to the head plate 121 during use of the oral care implement 100.

Of course, techniques other than AFT can be used for mounting the tooth cleaning elements 115 to the head 110, such as widely known and used stapling techniques or the like. In such embodiments the head plate 121 may be omitted and the tooth cleaning elements 115 may be coupled directly to the head 110. Furthermore, in a modified version of the AFT process discussed above, the head plate 121 may be formed by positioning the tooth cleaning elements 115 within a mold, and then molding the head plate 121 around the tooth cleaning elements 115 via an injection molding process.

Although described herein above with regard to using AFT, in certain embodiments any suitable form of cleaning elements and attachment may be used in the broad practice of this invention. Specifically, the tooth cleaning elements 115 of the present invention can be connected to the head 110 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 115 could be mounted to tuft blocks or sections by extending through suitable openings in the tuft blocks so that the base of the tooth cleaning elements 115 is mounted within or below the tuft block.

Although not illustrated herein, in certain embodiments the head 110 may also include a soft tissue cleanser coupled to or positioned on its rear surface 112. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

With reference to FIGS. 1-8, the oral care implement 100, and specifically the tooth cleaning elements 115 of the oral care implement 100, will be further described. In the exemplified embodiment, the plurality of tooth cleaning elements 115 comprises a first conical tuft 130 and a second conical tuft 140. Each of the first and second conical tufts 130, 140 is a tuft or grouping of bristles that are arranged together into a tuft and then secured into a single tuft hole within the head 110 (or within the head plate 121). The first and second conical tufts 130, 140 are described herein as being conical due to the first and second conical tufts 130, 140 having a conical shape. More specifically, as can best be seen in FIGS. 5, 6, and 8, the first and second conical tufts 130, 140 are in the shape of a truncated cone wherein the portion of the first and second conical tufts 130, 140 that are positioned within the head 110 is the truncated (i.e., cut off) portion of the cone such that the first and second conical tufts 130, 140 are in the shape of an inverted truncated cone.

The first conical tuft 130 comprises a first continuous bristle wall 135 having an inner surface 131 and an outer surface 136. The inner surface 131 of the first continuous bristle wall 135 of the first conical tuft 130 defines a first cavity 132 that extends along a first cavity axis C-C. The first conical tuft 130, and specifically the first continuous bristle wall 135 thereof, extends in a 360° manner about the first cavity axis C-C. The first cavity 132 of the first conical tuft 130 has an open top end and is bounded by the inner surface 131 of the first continuous bristle wall 135 and by the front surface 111 of the head 110. As noted above, the first conical tuft 130 in the exemplified embodiment is formed by a plurality of bristles. Specifically, the plurality of bristles are clumped together and positioned collectively into a single tuft hole so that the plurality of bristles collectively form the first conical tuft 130 having no gaps in the first continuous bristle wall 135 for its entire 360° extension about the first cavity axis C-C. Thus, the first conical tuft 130 extends from a single tuft hole. The term continuous bristle wall is intended to mean that the first conical tuft 130 is a single tuft of bristles that are clumped together into a single tuft hole in a non-spaced apart manner.

Thus, in the exemplified embodiment the first conical tuft 130 is a single bristle tuft formed from a plurality of individual bristles that are positioned together within a single tuft hole. As a result, the first conical tuft 130 has the first continuous bristle wall 135 that extends without discontinuity about the first cavity axis C-C. Thus, in the exemplified embodiment there are no gaps formed into the outer surface 136 of the first conical tuft 130. Of course, in other embodiments the first conical tuft 130 may have small gaps therein as desired while still being a single tuft positioned within a single tuft hole. Such gaps in the bristle wall may prevent dentifrice from being trapped within the first cavity 132 of the first conical tuft 130 by providing means of egress from the first cavity 132. In such an embodiment, the bristle wall 135 of the first conical tuft 130 may not be continuous.

Due to the conical shape of the first conical tuft 130, and more specifically, the inverted conical shape of the first conical tuft 130, the first cavity 132 of the first conical tuft 130 has a first transverse cross-sectional area that increases with distance from the front surface 111 of the head 110. Specifically, the first transverse cross-sectional area of the first cavity 132 of the first conical tuft 130 only increases and never decreases with distance from the front surface 111 of the head 110. Thus, the greater the distance between a particular axial location within the first cavity 132 of the first conical tuft 130 and the front surface 111 of the head 110, the greater the transverse cross-sectional area of the first cavity 132 at that particular axial location.

The second conical tuft 140 comprises a second continuous bristle wall 145 having an inner surface 141 and an outer surface 146. The inner surface 141 of the second continuous bristle wall 145 of the second conical tuft 140 defines a second cavity 142 that extends along a second cavity axis D-D. The second conical tuft 144 extends in a 360° manner about the second cavity axis D-D. The second cavity 142 of the second conical tuft 140 has an open top end and is bounded by the inner surface 141 of the second continuous bristle wall 145 and by the front surface 111 of the head 110. As noted above, the second conical tuft 140 in the exemplified embodiment is formed by a plurality of bristles. Specifically, the plurality of bristles are clumped together and positioned collectively into a single tuft hole so that the plurality of bristles collectively form the second conical tuft 140 having no gaps in the second continuous bristle wall 145 for its entire 360° extension about the second cavity axis D-D. Thus, the term continuous bristle wall is intended to mean that the second conical tuft 140 is a single tuft of bristles that are clumped together into a single tuft hole in a non-spaced apart manner.

Thus, in the exemplified embodiment the second conical tuft 140 is a single tuft formed from a plurality of individual bristles that are positioned together within a single tuft hole. As a result, the second conical tuft 140 has the second continuous bristle wall 145 that extends without discontinuity about the second cavity axis D-D. Thus, in the exemplified embodiment there are no gaps formed into the outer surface 146 of the second conical tuft 140. Of course, in other embodiments the second conical tuft 140 may have small gaps therein as desired while still being a single tuft positioned within a single tuft hole. Such gaps in the bristle wall may prevent dentifrice from being trapped within the second cavity 142 of the second conical tuft 140 by providing means of egress from the second cavity 142. In such an embodiment, the bristle wall 145 of the second conical tuft 140 may not be continuous.

Due to the conical shape of the second conical tuft 140, and more specifically, the inverted conical shape of the second conical tuft 140, the second cavity 142 of the second conical tuft 140 has a second transverse cross-sectional area that increases with distance from the front surface 111 of the head 110. Specifically, the second transverse cross-sectional area of the second cavity 142 of the second conical tuft 140 only increases and never decreases with distance from the front surface 111 of the head 110. Thus, the greater the distance between a particular axial location within the second cavity 142 of the second conical tuft 140 and the front surface 111 of the head 110, the greater the transverse cross-sectional area of the second cavity 142 at that particular axial location.

In the exemplified embodiment, the first conical tuft 130 is located at a distal region of the head 110 near the distal end 119 of the head 110 and the second conical tuft 140 is located at a proximal region of the head 110 near the proximal end 118 of the head 110. However, in the exemplified embodiment the first conical tuft 130 is not the distal-most tuft and the second conical tuft 140 is not the proximal-most tuft. Rather, there are tufts positioned between the first conical tuft 130 and the distal end 119 of the head 110 and there are tufts positioned between the second conical tuft 140 and the proximal end 118 of the head 110, as discussed in more detail below. Of course, in other embodiments the first and second conical tufts 130, 140 may be the proximal-most and distal-most tufts on the head 110. Furthermore, there are several different tooth cleaning elements positioned in between the first and second conical tufts 130, 140 in the direction of the longitudinal axis B-B as will be discussed in more detail below. In the exemplified embodiment, each of the first and second conical tufts 130, 140 is aligned on the longitudinal axis B-B such that the longitudinal axis B-B crosses through a center point of each of the first and second conical tufts 130, 140. The first and second conical tufts 130, 140 are on opposite sides of a transverse axis that is perpendicular to the longitudinal axis B-B and that divides the head 110 into two equal halves.

Figure 5:
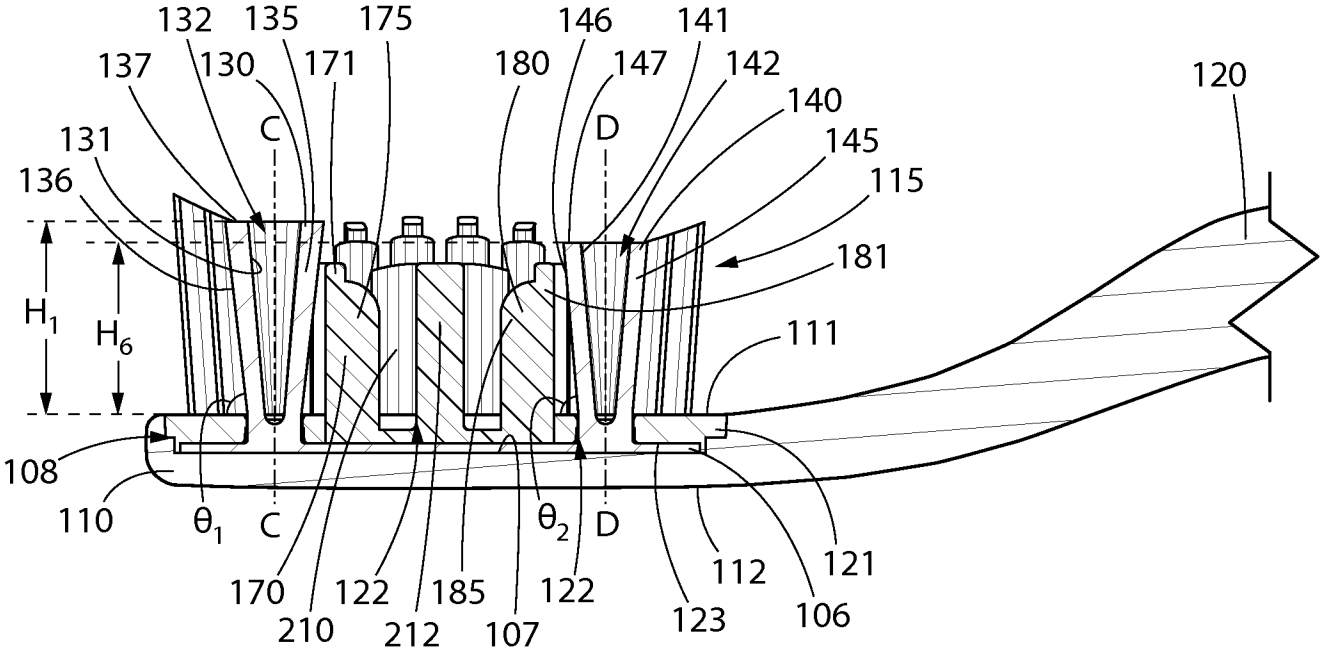
FIG. 5 is a cross-sectional view taken along line V-V of FIG. 3.
Figure 6:
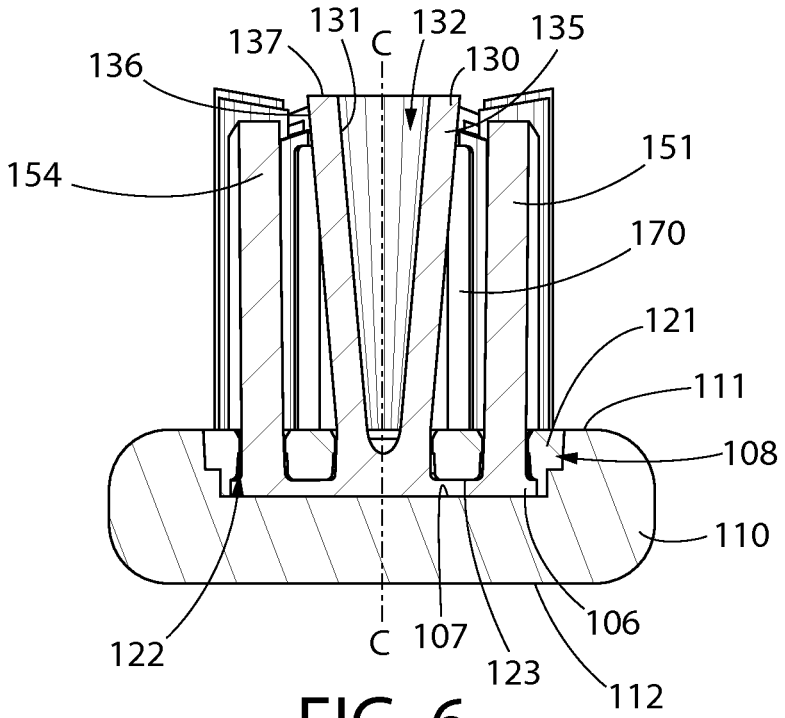
FIG. 6 is a cross-sectional view taken along line VI-VI of FIG. 3.
Figure 7:
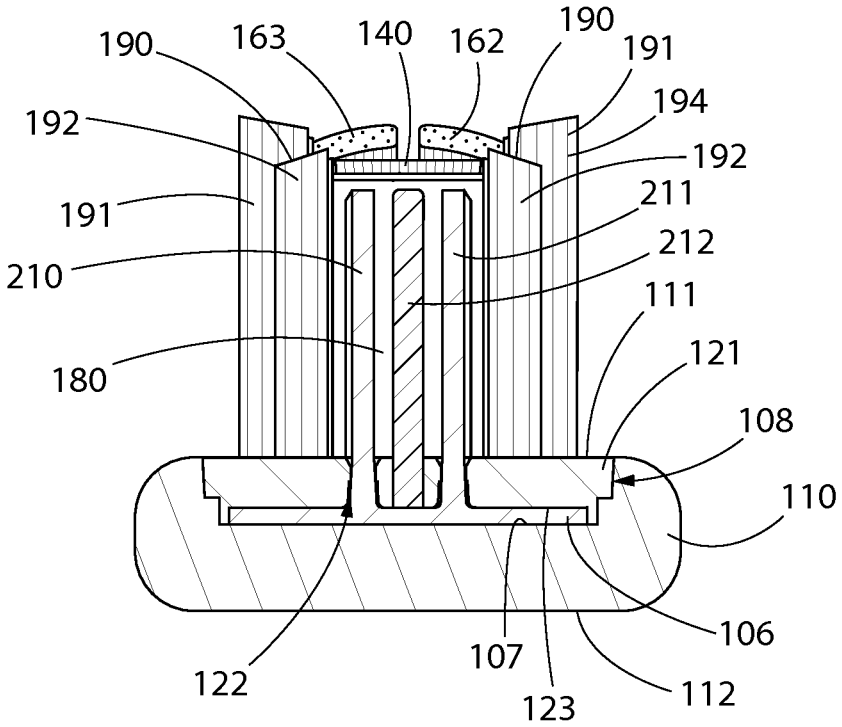
FIG. 7 is a cross-sectional view taken along line VII-VII of FIG. 3.
Figure 8:
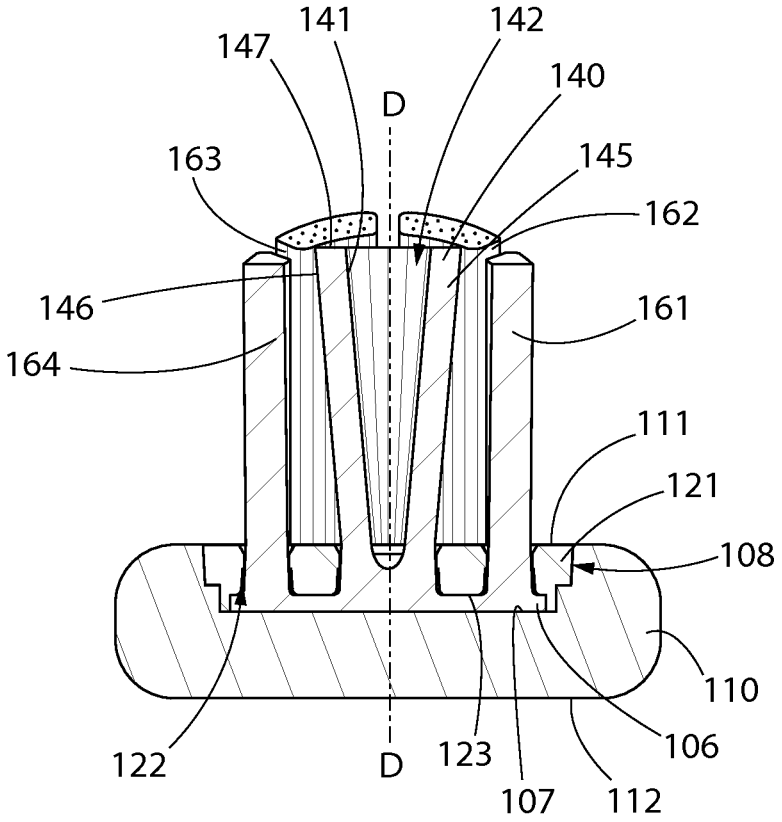
FIG. 8 is a cross-sectional view taken along line VIII-VIII of FIG. 3.

Referring briefly to FIGS. 3 and 5 concurrently, the first conical tuft 130 terminates in a first annular top surface 137 that extends a first height H1 above the front surface 111 of the head 110. The first conical tuft 130 also has a first outer diameter D1 taken at the first annular top surface 137 and at the outer surface 136. The second conical tuft 140 terminates in a second annular top surface 147 that extends a second height H6 above the front surface 111 of the head 110. The second conical tuft 140 also has a second outer diameter D2 taken at the second annular top surface 147 and at the outer surface 136. In the exemplified embodiment, the first height H1 is greater than the second height H6. However, in other embodiments the first and second heights H1, H6 may be the same, or the second height H6 may be greater than the first height H1. Furthermore, in the exemplified embodiment the first and second diameters D1, D2 are different, and more specifically the first diameter D1, D2 is greater than the second diameter. However, in certain other embodiments the first and second diameters D1, D2 may be the same, or the second diameter D2 may be greater than the first diameter D1.

Furthermore, the outer surface 136 of the first continuous bristle wall 135 of the first conical tuft 130 is oriented at a first acute angle Θ1 relative to the front surface 111 of the head 110. The outer surface 146 of the second continuous bristle wall 145 of the second conical tuft 140 is oriented at a second acute angle Θ2 relative to the front surface 111 of the head 110. In the exemplified embodiment, the first and second acute angles Θ1, Θ2 are different from one another. Specifically, in the exemplified embodiment the second acute angle Θ2 is greater than the first acute angle Θ1. Of course, the invention is not to be so limited in all embodiments and in certain other embodiments the first acute angle Θ1 may be greater than the second acute angle Θ2, or the first and second acute angles Θ1, Θ2 may be substantially the same. In certain embodiments, each of the first and second acute angles Θ1, Θ2 are between 80° and 89°, more specifically between 83.5° and 87.5°. In certain embodiments, one or both of the first and second acute angles Θ1, Θ2 is between 82° and 85°, and in other embodiments one or both of the first and second acute angles Θ1, Θ2 is between 86° and 89°. Furthermore, one of the first and second acute angles Θ1, Θ2 may be between 82° and 85° while the other one of the first and second acute angles Θ1, Θ2 is between 86° and 89°.

Although not depicted herein, in certain embodiments a central cleaning element may be positioned within each of the first and second cavities 132, 142 of the first and second conical tufts 130, 140. The central cleaning elements may be bristle tufts containing tapered bristles, spiral bristles, rounded bristles, or combinations thereof. Alternatively, the central cleaning elements may be elastomeric protrusions/elements.

In addition to the first and second conical tufts 130, 140, the plurality of tooth cleaning elements 115 also comprises a first arcuate cleaning element 150 and a second arcuate cleaning element 160. The first arcuate cleaning element 150 is at least partially located between the first conical tuft 130 and the distal end 119 of the head 110 and the second arcuate cleaning element 160 is at least partially located between the second conical tuft 140 and the proximal end 118 of the head 110. Thus, the first arcuate cleaning element 150 is the distal-most cleaning element on the head 110 and the second arcuate cleaning element 160 is the proximal-most cleaning element on the head 110. Stated another way, there are no intervening cleaning elements between the first arcuate cleaning element 150 and the distal end 119 of the head 110 and there are no intervening cleaning elements between the second arcuate cleaning element 160 and the proximal end 118 of the head 110.

In the exemplified embodiment, the first arcuate cleaning element 150 is formed of a plurality of bristle wall segments including a first segment 151, a second segment 152, a third segment 153, and a fourth segment 154. In this embodiment, each of the first, second, third, and fourth segments 151-154 is positioned within its own tuft hole that is spaced apart from the other tuft holes of the segments of the first arcuate cleaning element 150. Thus, in the exemplified embodiment the first segment 151 is spaced from the second segment 152 by a gap, the second segment 152 is spaced from the third segment 153 by a gap, and the third segment 153 is spaced from the fourth segment 154 by a gap. However, in certain other embodiments the first arcuate cleaning element 150 may be formed by a single continuous cleaning element that is positioned within a single tuft hole. Furthermore, in embodiments that include the spaced apart segments 151-154 that form the first arcuate cleaning element 150, the gaps between adjacent ones of the segments 151-154 may be considered as a part of the first arcuate cleaning element 150.

In the exemplified embodiment, the second arcuate cleaning element 160 is formed of a plurality of bristle wall segments including a first segment 161, a second segment 162, a third segment 163, and a fourth segment 164. In this embodiment, each of the first, second, third, and fourth segments 161-164 is positioned within its own tuft hole that is spaced apart from the other tuft holes of the segments of the second arcuate cleaning element 160. However, in certain other embodiments the second cleaning element 160 may be formed by a single continuous cleaning element that is positioned within a single tuft hole. Thus, in the exemplified embodiment, the first segment 161 is spaced from the second segment 162 by a gap, the second segment 162 is spaced from the third segment 163 by a gap, and the third segment 163 is spaced from the fourth segment 164 by a gap. However, in certain other embodiments the second arcuate cleaning element 160 may be formed by a single continuous cleaning element that is positioned within a single tuft hole. Furthermore, in embodiments that include the spaced apart segments 161-164 that form the first arcuate cleaning element 160, the gaps between adjacent ones of the segments 161-164 may be considered as a part of the second arcuate cleaning element 160.

Figure 4:
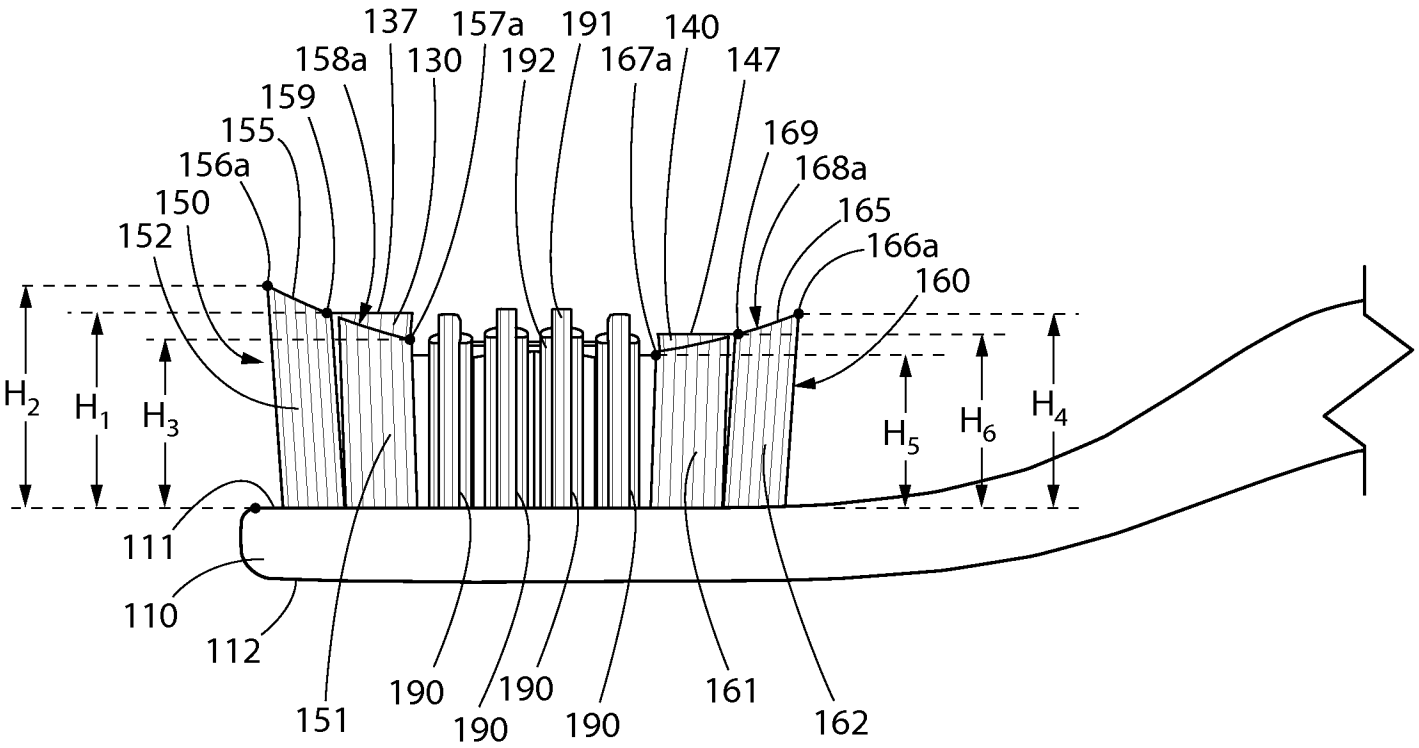
FIG. 4 is a side view of the head of the oral care implement of FIG. 2.

Referring briefly to FIGS. 2-4 concurrently, the oral care implement 100 will be further described. The first arcuate cleaning element 150 is arranged on the head 110 so as to at least partially surround the first conical tuft 130. Specifically, in the exemplified embodiment the first arcuate cleaning element 150 surrounds the first conical tuft 130 for at least 180° about the circumference of the first conical tuft 130, or between 180° and 270° about the circumference of the first conical tuft 130. In that regard, there are no other bristle tufts or cleaning elements positioned between the first arcuate cleaning element 150 and the first conical tuft 130 where the first arcuate cleaning element 150 surrounds the first conical tuft 130. In the exemplified embodiment, the second and third segments 152, 153 of the first arcuate cleaning element 150 are located between the first conical tuft 130 and the distal end 119 of the head 110 and the first and fourth segments 151, 154 of the first arcuate cleaning element 150 are located between the first conical tuft 130 and the lateral sides or peripheral edge of the head 110.

The first arcuate cleaning element 150 has a top surface 155 having a first high point 156*a* and a second high point 156*b*. The first high point 156*a* is located on the second segment 152 and the second high point 156*b* is located on the third segment 153. The first and second high points 156*a*, 156*b* are located on opposite sides of the longitudinal axis B-B. Furthermore, each of the first and second high points 156*a*, 156*b* extends to a second height H2 from the front surface 111 of the head 110. The top surface 155 of the first arcuate cleaning element 150 also has a first low point 157*a* and a second low point 157*b*. The first low point 157*a* is located on the first segment 151 and the second low point 157*b* is located on the fourth segment 154. The first and second low points 157*a*, 157*b* are located on opposite sides of the longitudinal axis B-B and on opposite sides of the first conical tuft 130. Furthermore, each of the first and second low points 157*a*, 157*b* extends to a third height H3 from the front surface 111 of the head 110.

Although noted herein as having first and second high points 156*a*, 156*b*, in certain embodiments the second and third segments 152, 153 may be formed as a single segment having a single high point located on the longitudinal axis B-B. Furthermore, in the exemplified embodiment the first and second high points 156*a*, 156*b* are the same height, and thus the first and second high points 156*a*, 156*b* may be considered a single high point in some embodiments.

The second arcuate cleaning element 160 is arranged on the head 110 so as to at least partially surround the second conical tuft 140. Specifically, in the exemplified embodiment the second arcuate cleaning element 160 surrounds the second conical tuft 140 for at least 180° about the circumference of the second conical tuft 140, or between 180° and 270° about the circumference of the second conical tuft 140. In that regard, there are no other bristle tufts or cleaning elements positioned between the second arcuate cleaning element 160 and the second conical tuft 140 where the second arcuate cleaning element 160 surrounds the second conical tuft 140. In the exemplified embodiment, the second and third segments 162, 163 of the second arcuate cleaning element 160 are located between the second conical tuft 140 and the proximal end 118 of the head 110 and the first and fourth segments 161, 164 of the second arcuate cleaning element 160 are located between the second conical tuft 140 and the lateral sides or peripheral edge of the head 110.

The second arcuate cleaning element 160 has a top surface 165 having a first high point 166*a* and a second high point 166*b*. The first high point 166*a* is located on the second segment 162 and the second high point 166*b* is located on the third segment 163. The first and second high points 166*a*, 166*b* are located on opposite sides of the longitudinal axis B-B. Furthermore, each of the first and second high points 166*a*, 166*b* is located at a fourth height H4 from the front surface 111 of the head 110. The top surface 155 of the second arcuate cleaning element 160 also has a first low point 167*a* and a second low point 167*b*. The first low point 167*a* is located on the first segment 161 and the second low point 167*b* is located on the fourth segment 164. The first and second low points 167*a*, 167*b* are located on opposite sides of the longitudinal axis B-B and on opposite sides of the second conical tuft 140. Furthermore, each of the first and second low points 167*a*, 167*b* is located at a fifth height H5 from the front surface 111 of the head 110.

Although noted herein as having first and second high points 166*a*, 166*b*, in certain embodiments the second and third segments 162, 163 may be formed as a single segment having a single high point located on the longitudinal axis B-B. Furthermore, in the exemplified embodiment the first and second high points 166*a*, 166*b* may be the same height, and thus the first and second high points 166*a*, 166*b* may be considered a single high point in some embodiments.

In the exemplified embodiment, the first height H1 (which is the height at which the annular top surface 137 of the first conical tuft 130 extends from the front surface 111 of the head 110) is greater than the third height H3 and less than the second height H2. Similarly, in the exemplified embodiment the sixth height H6 (which is the height at which the annular top surface 147 of the second conical tuft 140 extends from the front surface 111 of the head 110) is greater than the fifth height H5 and less than the fourth height H4. Furthermore, in the exemplified embodiment the third height H3 is greater than the fifth height H5, and the second height H2 is greater than the fourth height H4. Thus, each of the cleaning elements in the distal region of the head 110 is taller than its counterpart in the proximal region of the head 110 (the high point 156*a*, 156*b* of the first arcuate cleaning element 150 is taller than the high point 166*a*, 166*b* of the second arcuate cleaning element 160, the low point 157*a*, 157*b* of the first arcuate cleaning element 150 is taller than the low point 167*a*, 167*b* of the second arcuate cleaning element 160, and the first conical tuft 130 is taller than the second conical tuft 140).

In the exemplified embodiment the top surface 155 of the first arcuate cleaning element 150 comprises a first ramped portion 158*a* extending from the first low point 157*a* to the first high point 156*a* (visible in FIG. 4) and a second ramped portion 158*b* extending from the second low point 157*b* to the second high point 156*b* (not visible in FIG. 4, but denoted in FIG. 2). In the exemplified embodiment, each of the first and second ramped portions 158*a*, 158*b* of the top surface 155 of the first arcuate cleaning element 150 have a constant slope (i.e., the ramped portions 158*a*, 158*b* are linear), although in other embodiments the slope may gradually increase or decrease when extending from the low points 157*a*, 157*b* to the high points 156*a*, 156*b* as desired. Similarly, the top surface 165 of the second arcuate cleaning element 160 comprises a first ramped portion 168*a* extending from the first low point 167*a* to the first high point 166*a* (visible in FIG. 4) and a second ramped portion 168*b* extending from the second low point 167*b* to the second high point 166*b* (not visible in FIG. 4, but denoted in FIG. 2). In the exemplified embodiment, each of the first and second ramped portions 168*a*, 168*b* of the top surface 165 of the second arcuate cleaning element 160 have a constant slope (i.e., the ramped portions 168*a*, 168*b* are linear), although in other embodiments the slope may gradually increase or decrease when extending from the low points 167*a*, 167*b* to the high points 166*a*, 166*b* as desired.

Furthermore, in embodiments wherein the first arcuate cleaning element 150 is a single continuous cleaning element, the first and second high points 156*a*, 156*b* of the first arcuate cleaning element 150 may be located along a reference plane that includes the longitudinal axis B-B and is perpendicular to the front surface 111 of the head 110. Furthermore, even when the first arcuate cleaning element 150 is formed by separate bristle segments 151-154 having gaps therebetween, conceptually the high points 156*a*, 156*b* may still be located along the reference plane that includes the longitudinal axis B-B and is perpendicular to the front surface 111 of the head 110. Furthermore, as can be seen in FIG. 4, when viewed in side profile the first ramped portion 158*a* (and also the second ramped portion 158*b*, although not visible in FIG. 4) of the top surface 155 of the first arcuate cleaning element 150 intersects the annular top surface 137 of the first conical tuft 130 at a first intersection point 159.

Similarly, in embodiments wherein the second arcuate cleaning element 160 is a single continuous cleaning element, the first and second high points 166*a*, 166*b* of the second arcuate cleaning element 160 may be located along a reference plane that includes the longitudinal axis B-B and is perpendicular to the front surface 111 of the head 110. Furthermore, even when the second arcuate cleaning element 160 is formed by separate bristle segments 161-164 having gaps therebetween, conceptually the high points 166*a*, 166*b* may still be located along the reference plane that includes the longitudinal axis B-B and is perpendicular to the front surface 111 of the head 110. Furthermore, as can be seen in FIG. 4, when viewed in side profile the first ramped portion 168*a* (and also the second ramped portion 168*b*, although not visible in FIG. 4) of the top surface 165 of the second arcuate cleaning element 160 intersects the annular top surface 147 of the second conical tuft 140 at a second intersection point 169.

Referring to FIGS. 1-3 and 5 concurrently, the oral care implement 100 will be further described. As noted above, in the exemplified embodiment the first arcuate cleaning element 150 only partially surrounds the first conical tuft 130 and the second arcuate cleaning element 160 only partially surrounds the second conical tuft 140. However, the plurality of tooth cleaning elements 115 further comprise a first arcuate elastomeric wall 170 positioned adjacent to the first conical tuft 130 and a second arcuate elastomeric wall 180 positioned adjacent to the second conical tuft 140. In the exemplified embodiment, each of the first and second arcuate elastomeric walls 170, 180 is formed of a resilient elastomeric material, such as a thermoplastic elastomer. This is different than the first and second arcuate cleaning elements 150, 160 and the first and second conical tufts 130, 140, which are formed as tufts of bristles.

The first arcuate elastomeric wall 170 has an arcuate section 171 and a support section 175. The arcuate section 171 has an inner concave surface 172 and an outer convex surface 173. The inner concave surface 172 of the arcuate section 171 of the first elastomeric wall 170 is adjacent to and faces the first conical tuft 130. The first arcuate elastomeric wall 170 is located on the head 110 in between the first conical tuft 130 and the proximal end 118 of the head 110. Thus, as can be seen, the first arcuate cleaning element 150 and the first arcuate elastomeric wall 170 collectively completely surround the first conical tuft 130. The support section 175 of the first arcuate elastomeric wall 170 extends from the outer convex surface 173 of the arcuate section 171 of the first arcuate elastomeric wall 170. More specifically, the support section 175 extends from the outer convex surface 173 of the arcuate section 171 along and in the direction of the longitudinal axis B-B and in a direction away from the first conical tuft 130. The first arcuate elastomeric wall 170 provides support for the first conical tuft 130 such that flexing of the bristles of the first conical tuft 130 in the direction of the first arcuate elastomeric wall 170 will be kept to a minimum during brushing.

The arcuate section 171 of the first arcuate elastomeric wall 170 terminates in a top surface 174. Furthermore, the support section 175 of the first arcuate elastomeric wall 170 terminates in a top surface 176. The top surface 174 of the arcuate section 171 of the first arcuate elastomeric wall 170 extends a greater height from the front surface 111 of the head 110 than the top surface 176 of the support section 175 of the first arcuate elastomeric wall 170.

The second arcuate elastomeric wall 180 has an arcuate section 181 and a support section 185. The arcuate section 181 has an inner concave surface 182 and an outer convex surface 183. The inner concave surface 182 of the arcuate section 181 of the second elastomeric wall 180 is adjacent to and faces the second conical tuft 140. The second arcuate elastomeric wall 180 is located on the head 110 in between the second conical tuft 140 and the distal end 119 of the head 110. Thus, as can be seen, the second arcuate elastomeric element 160 and the second arcuate elastomeric wall 180 collectively completely surround the second conical tuft 140. The support section 185 of the second arcuate elastomeric wall 180 extends from the outer convex surface 183 of the arcuate section 181 of the second arcuate elastomeric wall 180. More specifically, the support section 185 extends from the outer convex surface 183 of the arcuate section 181 along and in the direction of the longitudinal axis B-B and in a direction away from the second conical tuft 140. The second arcuate elastomeric wall 180 provides support for the second conical tuft 140 such that flexing of the second conical tuft 140 in the direction of the second arcuate elastomeric wall 180 will be kept to a minimum during brushing.

The arcuate section 181 of the second arcuate elastomeric wall 180 terminates in a top surface 184. Furthermore, the support section 185 of the second arcuate elastomeric wall 180 terminates in a top surface 186. The top surface 184 of the arcuate section 181 of the second arcuate elastomeric wall 180 extends a greater height from the front surface 111 of the head 110 than the top surface 186 of the support section 185 of the second arcuate elastomeric wall 180.

Referring now to FIGS. 2-4 and 7 concurrently, the oral care implement 100 will be further described. In addition to the above, the tooth cleaning elements 115 also comprise at least one multi-height bristle tuft 190 that extends from a single tuft hole along a tuft axis. In certain embodiments, the invention may be directed to the inclusion of one or more of the multi-height bristle tufts 190 on the head 110 regardless of the structure, pattern, shape, and configuration of the other tooth cleaning elements that are on the head.

In the exemplified embodiment, a plurality of the multi-height bristle tufts 190 are positioned on opposing sides of the longitudinal axis B-B. Specifically, in the exemplified embodiment there are four multi-height bristle tufts 190 positioned between the first segment 151 of the first arcuate cleaning element 150 and the first segment 161 of the second arcuate cleaning element 160 along a first lateral edge of the head 110. Similarly, in the exemplified embodiment there are four multi-height bristle tufts 190 positioned between the fourth segment 154 of the first arcuate cleaning element 150 and the fourth segment 164 of the second arcuate cleaning element 160 along a second lateral edge of the head 110. Of course, more or less than four of the multi-height bristle tufts 190 can be used on the opposing lateral sides of the head 110 in other embodiments as desired. The specific details of the multi-height bristle tufts 190 will only be denoted in the drawings with regard to one or a couple of the multi-height bristle tufts 190 in order to avoid clutter, it being understood that each of the multi-height bristle tufts 190 has an identical structure.

Each of the multi-height bristle tufts 190 comprises a first bristle tuft section 191 and a second bristle tuft section 192. The first bristle tuft section 191 has a rectangular transverse cross-sectional shape and the second bristle tuft section 192 has a U-shaped transverse cross-sectional shape. Despite the multi-height bristle tufts 190 being formed of two different bristle tuft sections having two different shapes, each multi-height bristle tuft 190 is positioned within a single tuft hole 189. Thus, the tuft holes 189 within which the multi-height bristle tufts 190 are positioned have a U-shaped portion and a rectangular-shaped portion that are in spatial communication with each other.

As noted above, the second bristle tuft section 192 of the multi-height bristle tufts 190 has a U-shaped transverse cross-sectional shape. Thus, the second bristle tuft sections 192 have edges at the top of each of the legs of the "U" and a cavity defined between the legs of the "U." The first bristle tuft section 191 is positioned within the U-shaped cavity formed by the second bristle tuft section 192 such that the second bristle tuft sections 192 at least partially surround the first bristle tuft sections 191. Each of the first bristle tuft sections 191 has first and second major surfaces and first and second minor surfaces. In the exemplified embodiment, one of the minor surfaces and a portion of each of the major surfaces is surrounded by (and in the exemplified embodiment in contact with) the second bristle tuft section 192. The other minor surface and the remainder of the major surfaces of the first bristle tuft sections 191 is exposed and not surrounded by the second bristle tuft section 192.

In the exemplified embodiment, approximately one-half of the transverse-cross section of the first bristle tuft sections 191 is positioned within the U-shaped cavity of the second bristle tuft sections 192, the other half of the transverse cross-section of the first bristle tuft sections 191 extending from the U-shaped cavity. Thus, the first bristle tuft sections 191 extend further laterally away from the longitudinal axis B-B than the second bristle tuft sections 192. The first bristle tuft sections 191 comprise a first portion 193 that is nested within the U-shape of the second bristle tuft section 192 and a second portion 194 that transversely protrudes from the U-shape of the second bristle tuft sections 192 in the direction of the lateral sides of the head 110. The first portion 193 of the first bristle tuft sections 191 that are nested within the U-shape of the second bristle tuft sections 192 are in surface contact with the second bristle tuft section 192. The second bristle tuft sections 192 are positioned closer to the longitudinal axis B-B of the head 110 than the first bristle tuft sections 191 because the "U" of the second bristle tuft sections 192 wraps around the side of the first bristle tuft sections 191 that is closest to the longitudinal axis B-B of the head 110.

The multi-height bristles 190 on the first lateral side of the head 110 are longitudinally aligned with the multi-height bristles 190 on the second lateral side of the head 110. Furthermore, the convex portions of the "U" of the second bristle tuft sections 192 of the multi-height bristles 190 on the first lateral side of the head 110 are in facing relation with the convex portions of the U of the second bristle tuft sections 192 of the multi-height bristles 190 on the second lateral side of the head 110. The first bristle tuft sections 191 of the multi-height bristles 190 extend a greater height from the front surface 111 of the head 110 than the second bristle tuft sections 192. Thus, the second bristle tuft sections 192 partially surround the first bristle tuft sections 191 and the first bristle tuft sections 191 axially protrude from an upper surface of the second bristle tuft sections 192.

The tooth cleaning elements 115 also include first and second arcuate walls 210, 211 and a central elastomeric wall 212. The first and second arcuate walls 210, 211 and the central elastomeric wall 212 are located centrally on the head in between the first and second arcuate elastomeric walls 170, 180. The first and second arcuate walls 210, 211 each have a convex surface and a concave surface. The convex surface of the first and second arcuate walls 210, 211 are facing each other. The concave surface of the first arcuate wall 210 is facing the first set of the multi-height bristle tufts 190 on the first lateral side of the head. The concave surface of the second arcuate wall 211 is facing the second set of multi-height bristle tufts 190 on the second lateral side of the head. The central elastomeric wall 212 is positioned on and elongated along the longitudinal axis B-B and is adjacent to the convex surfaces of each of the first and second arcuate walls 210, 211.

In the exemplified embodiment, the collection of the tooth cleaning elements 115 are all symmetric about the longitudinal axis B-B and about a transverse axis that is perpendicular to the longitudinal axis B-B and that divides the head 110 into two equal halves. Thus, the pattern of the tooth cleaning elements 115 is such that they have lateral and longitudinal symmetry.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface and a longitudinal axis extending from a proximal end of the head to a distal end of the head;

a plurality of tooth cleaning elements extending from the front surface of the head;

the plurality of tooth cleaning elements comprising a conical tuft comprising a bristle wall having an inner surface defining a cavity along a cavity axis, the cavity having a transverse cross-sectional area that increases with distance from the front surface of the head, the conical tuft terminating in an annular top surface, the annular top surface being a first height from the front surface of the head; and the plurality of tooth cleaning elements comprising an arcuate cleaning element at least partially surrounding the conical tuft, the arcuate cleaning element having a top surface having a high point being a second height from the front surface of the head and a first low point being a third height from the front surface of the head;

wherein the first height is greater than the third height and less than the second height; and wherein the conical tuft extends from a single tuft hole.

2. The oral care implement according to claim 1 wherein the top surface of the arcuate cleaning element further comprises a second low point being the third height from the front surface of the head, the first and second low points located on opposite sides of the conical tuft.

3. The oral care implement according to claim 2 wherein the top surface of the arcuate cleaning element comprises a first ramped portion extending from the first low point to the high point and a second ramped portion extending from the second low point to the high point.

4. The oral care implement according to claim 1 wherein the arcuate cleaning element is a distal-most tooth cleaning element on the head.

5. The oral care implement according to claim 1 wherein the arcuate cleaning element is a proximal-most tooth cleaning element on the head.

6. The oral care implement according to claim 1 wherein the arcuate cleaning element only partially surrounds the conical tuft, wherein the plurality of tooth cleaning elements further comprise an arcuate elastomeric wall positioned adjacent the conical tuft such that the arcuate cleaning element and the arcuate elastomeric wall collectively surround the conical tuft, and wherein the arcuate elastomeric wall comprises an inner surface facing the conical tuft and an outer surface, the arcuate elastomeric wall further comprising a support section extending from the outer surface that is coupled to the head.

7. The oral care implement according to claim 1 wherein the arcuate cleaning element is formed by a plurality of bristle wall segments.

8. An oral care implement comprising:

a handle;

a head coupled to the handle, the head comprising a front surface and a longitudinal axis extending from a proximal end of the head to a distal end of the head;

a plurality of tooth cleaning elements extending from the front surface of the head;

the plurality of tooth cleaning elements comprising a conical tuft comprising a bristle wall having an inner surface defining a cavity along a cavity axis, the cavity having a transverse cross-sectional area that increases with distance from the front surface of the head; and the plurality of tooth cleaning elements comprising an arcuate cleaning element at least partially surrounding the conical tuft;

wherein the arcuate cleaning element is either a distal-most tooth cleaning element on the head or a proximal-most tooth cleaning element on the head;

wherein a top surface of the arcuate cleaning element further comprises a first ramped portion; and wherein when viewed in side profile, the first ramped portion of the top surface of the arcuate cleaning element intersects an annular top surface of the conical tuft; and wherein the conical tuft extends from a single tuft hole.

9. The oral care implement according to claim 8 wherein the plurality of tooth cleaning elements further comprise an arcuate elastomeric wall positioned adjacent the conical tuft, wherein the arcuate elastomeric wall comprises an inner surface facing the conical tuft and an outer surface, the arcuate elastomeric wall further comprising a support section extending from the outer surface that is coupled to the head.

10. An oral care implement comprising:

a handle;

a head coupled to the handle, the head comprising a front surface and a longitudinal axis extending from a proximal end of the head to a distal end of the head;

a plurality of tooth cleaning elements extending from the front surface of the head;

the plurality of tooth cleaning elements comprising a first conical tuft comprising a first bristle wall having an inner surface defining a first cavity along a first cavity axis, the first cavity having a first transverse cross-sectional area that increases with distance from the front surface of the head, the first bristle wall having an outer surface that forms a first acute angle with the front surface;

the plurality of tooth cleaning elements comprising a second conical tuft comprising a second bristle wall having an inner surface defining a second cavity along a second cavity axis, the second cavity having a second transverse cross-sectional area that increases with distance from the front surface of the head, the second bristle wall having an outer surface that forms a second acute angle with the front surface; and wherein the first and second acute angles are different from one another.

11. The oral care implement according to claim 10 wherein the plurality of tooth cleaning elements further comprise a first arcuate cleaning element at least partially surrounding the first conical tuft and a second arcuate cleaning element at least partially surrounding the second conical tuft.

12. The oral care implement according to claim 11 wherein the first arcuate cleaning element is a distal-most tooth cleaning element on the head and the second arcuate cleaning element is a proximal-most tooth cleaning element on the head.

13. The oral care implement according to claim 10 wherein the plurality of tooth cleaning elements further comprise a first arcuate elastomeric wall positioned adjacent the first conical tuft such that the first arcuate cleaning element and the first arcuate elastomeric wall collectively surround the first conical tuft; and wherein the plurality of tooth cleaning elements further comprise a second arcuate elastomeric wall positioned adjacent the second conical tuft such that the second arcuate cleaning element and the second arcuate elastomeric wall collectively surround the second conical tuft.

14. The oral care implement according to claim 10 wherein each of the first and second conical tufts extend from a single tuft hole.

15. The oral care implement according to claim 10 wherein the first conical tuft terminates in a first annular top surface and wherein the second conical tuft terminates in a second annular top surface, the first annular top surface being a first height from the front surface of the head and the second annular top surface being a sixth height from the front surface of the head, the first and sixth heights being different.

* * * * *